US009735507B1

(12) United States Patent
Liang

(10) Patent No.: US 9,735,507 B1
(45) Date of Patent: Aug. 15, 2017

(54) LOCKING STRUCTURE OF TELECOMMUNICATION CONNECTOR

(71) Applicant: Yu-Ho Liang, New Taipei (TW)

(72) Inventor: Yu-Ho Liang, New Taipei (TW)

( * ) Notice: Subject to any disclaimer, the term of this patent is extended or adjusted under 35 U.S.C. 154(b) by 0 days.

(21) Appl. No.: 15/359,866

(22) Filed: Nov. 23, 2016

(51) Int. Cl.

| | |
|---|---|
| ***H01R 13/44*** | (2006.01) |
| ***H01R 13/639*** | (2006.01) |
| ***H01R 24/64*** | (2011.01) |
| *H01R 107/00* | (2006.01) |
| *H01R 13/627* | (2006.01) |
| *H01R 13/506* | (2006.01) |

(52) U.S. Cl.
CPC ..... *H01R 13/6397* (2013.01); *H01R 24/64* (2013.01); *H01R 13/506* (2013.01); *H01R 13/6272* (2013.01); *H01R 13/6275* (2013.01); *H01R 2107/00* (2013.01)

(58) Field of Classification Search
USPC ..... 439/133, 134, 344, 354
See application file for complete search history.

(56) References Cited

U.S. PATENT DOCUMENTS 7,540,756 B1 * 6/2009 Strahl ..... H01R 13/6272 439/344
7,806,706 B2 * 10/2010 Obenshain ..... H01R 13/6395 439/133
8,323,042 B2 * 12/2012 Lin ..... H01R 13/443 439/133
8,545,243 B2 * 10/2013 Lin ..... H01R 13/6397 439/133
8,672,694 B2 * 3/2014 Lee ..... H01R 13/443 439/133
9,350,114 B2 * 5/2016 Liang ..... H01R 13/6275

FOREIGN PATENT DOCUMENTS

DE 202015000867 U1 * 3/2015 ..... H01R 13/627

* cited by examiner

*Primary Examiner* — Tho D Ta
(74) *Attorney, Agent, or Firm* — Rosenberg, Klein & Lee

(57) ABSTRACT

A locking structure is provided for a telecommunication connector and includes a pull resistant section, which has a front end forming an engagement section connected to a connection surface that is connected to a spring arm, which is provided with a projection; a locking section, which is a U-shaped configuration; and a connection section, which connects the pull resistant section and the locking section and is formed with a cavity, which has an end section in which an opening is formed to correspond to the spring arm. The locking structure is combinable with a connector body to form a telecommunication connector that is insertable into a socket, such that the pull resistant section is received into an insertion hole of the socket and the spring arm is brought into engagement with blocks formed inside the socket so as to prevent the telecommunication connector from being removed out of the socket.

9 Claims, 13 Drawing Sheets

LOCKING STRUCTURE OF TELECOMMUNICATION CONNECTOR

FIELD OF THE INVENTION

The present invention relates to a locking structure of a telecommunication connector, and in particular to a locking structure that requires operation of a corresponding unlocker to remove a telecommunication connector that is plugged in a socket from the socket and is applicable to all sorts of LC series connectors and RJ series jacks.

BACKGROUND OF THE INVENTION

A conventional telecommunication connector is structurally provided with a spring arm so that when the conventional telecommunication connector is plugged into a socket, the spring arm engages a projection block formed in an insertion hole of the socket. To remove the telecommunication connector from the socket, the spring arm must be pressed down to disengage from the projection block in order to allow the telecommunication connector to be pulled out of the socket.

However, frequent insertion and removal of the telecommunication connector often leads to fatigue of the spring arm, making it loss the function of engaging with the projection block of the socket. Also, excessive use of the spring arm after a long term of use may cause break of the spring arm, and again making it loss the function of engaging with the projection block of the socket, and eventually easy detachment may result. In both cases of fatigue and break of the spring arm, the telecommunication connector must be replaced with a fresh one. This takes time and additional cost and would lead to unnecessary waste of parts and time.

In addition, the structure of the conventional telecommunication connector makes only the engagement between the spring arm and the block formed in the insertion hole of a socket and this would allow the telecommunication connector to be easily removed and/or plugged by every one around. In case that the telecommunication connector is inadvertently removed during transmission of data, the connection is cut off and transmission is stopped. This is apparently due to no removal protection feature being provided. In addition, the telecommunication connector may be removed from the socket by an unauthorized person without proper permission for malicious intentions for example data stealing. This is apparently deficiency of absence of data security and protection.

In view of the above, the present invention aims to provide a locking structure that requires operation of a corresponding unlocker to allow a telecommunication connector, after being plugged into a socket, to be removed from the socket in order to overcome the shortcomings of the prior art and improve industrial application thereof.

SUMMARY OF THE INVENTION

The primary objective of the present invention is to provide a locking structure of a telecommunication connector, which comprises a pull resistant section and a locking section connected together by a connection section and the locking structure is connected through the locking section to a connector body to form a telecommunication connector that is insertable or pluggable into a socket, wherein the pull resistant section of the locking structure is received and concealed in an insertion hole of the socket and spring arms of the pull resistant section are brought into engagement with a plurality of raised blocks formed inside the socket, such that an unlocker of a specific design must be used by inserting into the locking structure to release the engagement between the locking structure and the socket. As such, unauthorized or unexpected removal of the telecommunication connector is prevented and security and protection of data can be enhanced against being stolen by others. The present invention can be used, in a condition that a conventional spring arm of a telecommunication connector is broken or undergoes elastic fatigue, to replace the conventional spring arm through combination with the conventional telecommunication connector, or may alternatively, be integrally formed with a connector body to form a telecommunication connector, both being helpful in preventing the telecommunication connector from being removed or pulled out of a socket unexpectedly.

Thus, to achieve the above objective, the present invention provides a locking structure of a telecommunication connector, which comprises: a pull resistant section, which has a front end forming an engagement section connected to a connection surface, the connection surface being connected to at least one spring arm, the spring arm being provided with a projection on an underside thereof; a locking section, which is a U-shaped configuration; and a connection section, which connects the pull resistant section and the locking section, the connection section being formed with a cavity, the cavity having an end section in which an opening is formed to correspond to the spring arm; wherein the locking structure is combinable with a connector body to form the telecommunication connector, which is pluggable into a socket such that the pull resistant section is received into and concealed in an insertion hole of the socket and the spring arm is in engagement with a plurality of raised blocks formed inside the socket to prevent the telecommunication connector from being removed out of the socket.

In the above locking structure, the engagement section and the connection surface comprise a first reinforcement section formed therebetween and the spring arm comprises a second reinforcement section formed on the underside thereof and connected to the projection.

In the above locking structure, the pull resistant section extends in a direction toward the insertion hole and the spring arm of the pull resistant section extends in a direction toward the locking section.

In the above locking structure, the locking section comprises a vertical board, a horizontal board, two side boards, two barbs, and two stops, the vertical board being mounted on the horizontal board to be perpendicular thereto, the vertical board comprising a hole in a bottom edge thereof such that the hole corresponds to the cavity of the connection section, the horizontal board being arranged between the side boards and connected to the side boards, the barbs and the stops being mounted to lower ends of the side boards.

In the above locking structure, at least one reinforcement member is provided at connection between the vertical board and the horizontal board.

In the above locking structure, the connector body wraps and houses an end of a cable and the connector body comprises a protrusion formed at a top of a front end thereof, the connector body comprising barbs and stops formed at a bottom of a rear end thereof such that the combination of the locking structure and the connector body brings the barbs and the stops of the locking section into retaining engagement with the barbs and the stops of the connector body and the horizontal board and the side boards of the locking section respectively cover a top and sides of the connector body, the engagement section of the front end of the pull resistant section being brought into engagement with the protrusion.

In the above locking structure, the locking structure and the connector body are integrally formed together as a unitary structure.

In the above locking structure, an unlocker is operable to move the projection on the underside of the spring arm in order to release the engagement between the spring arm and the raised blocks and allow the telecommunication connector to be removed out of the socket.

In the above locking structure, the unlocker has an end that comprises at least one extension arm, and the extension arm has an end portion having an interior space having an inside surface forming a slope surface, such that the slope surface of the extension arm, when brought into camming engagement with the projection on the underside of the spring arm, causes the spring arm to break the engagement thereof with the raised blocks so as to allow the telecommunication connector to be removed out of the socket.

In the above locking structure, the unlocker comprises a hole formed therein

In the above locking structure, the unlocker comprises an accommodation space formed therein.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
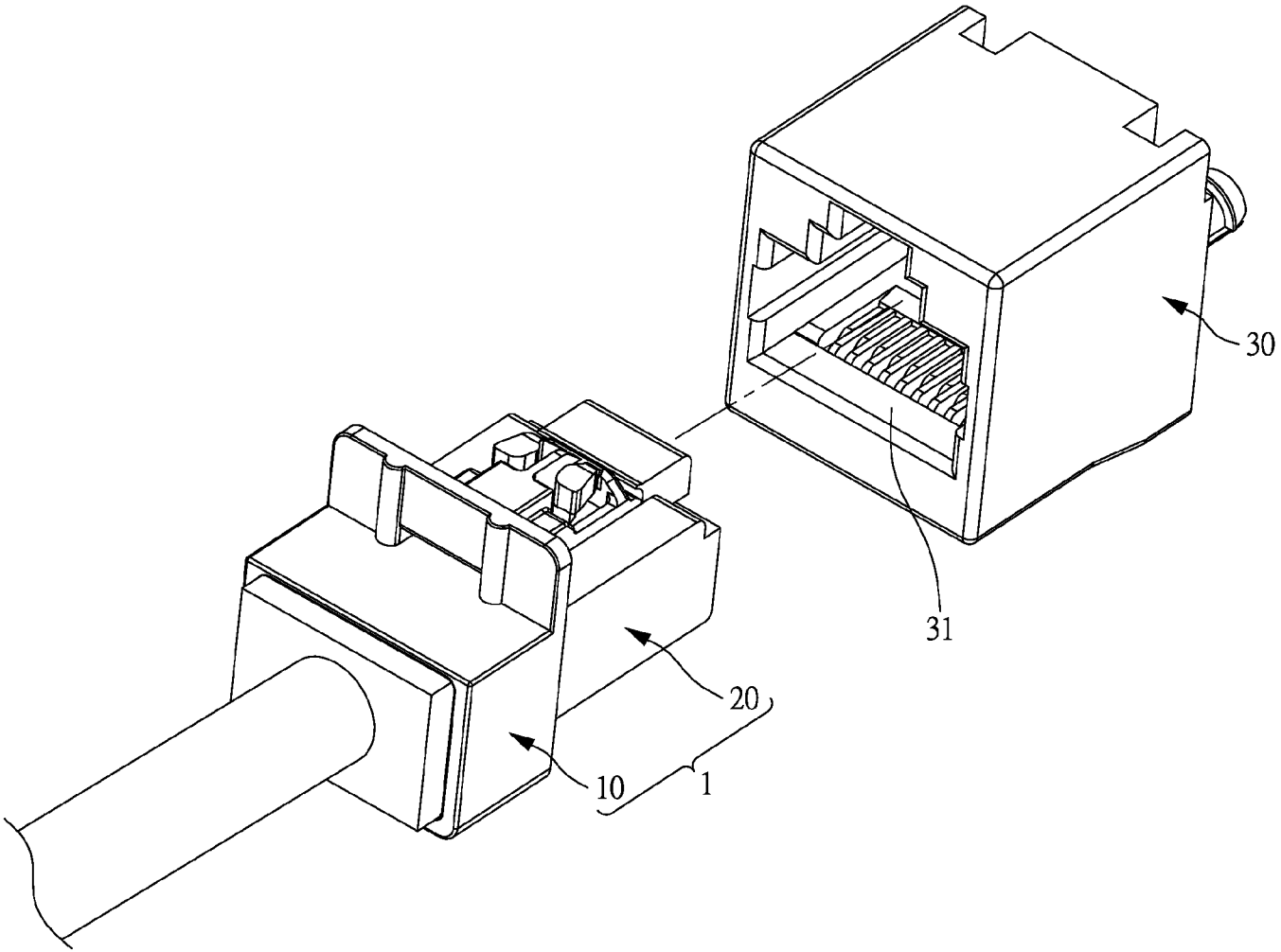
FIG. 1 is a perspective view showing a locking structure of a telecommunication connector according to the present invention and a corresponding connector body, as well as socket into which the connector is pluggable.
Figure 2:
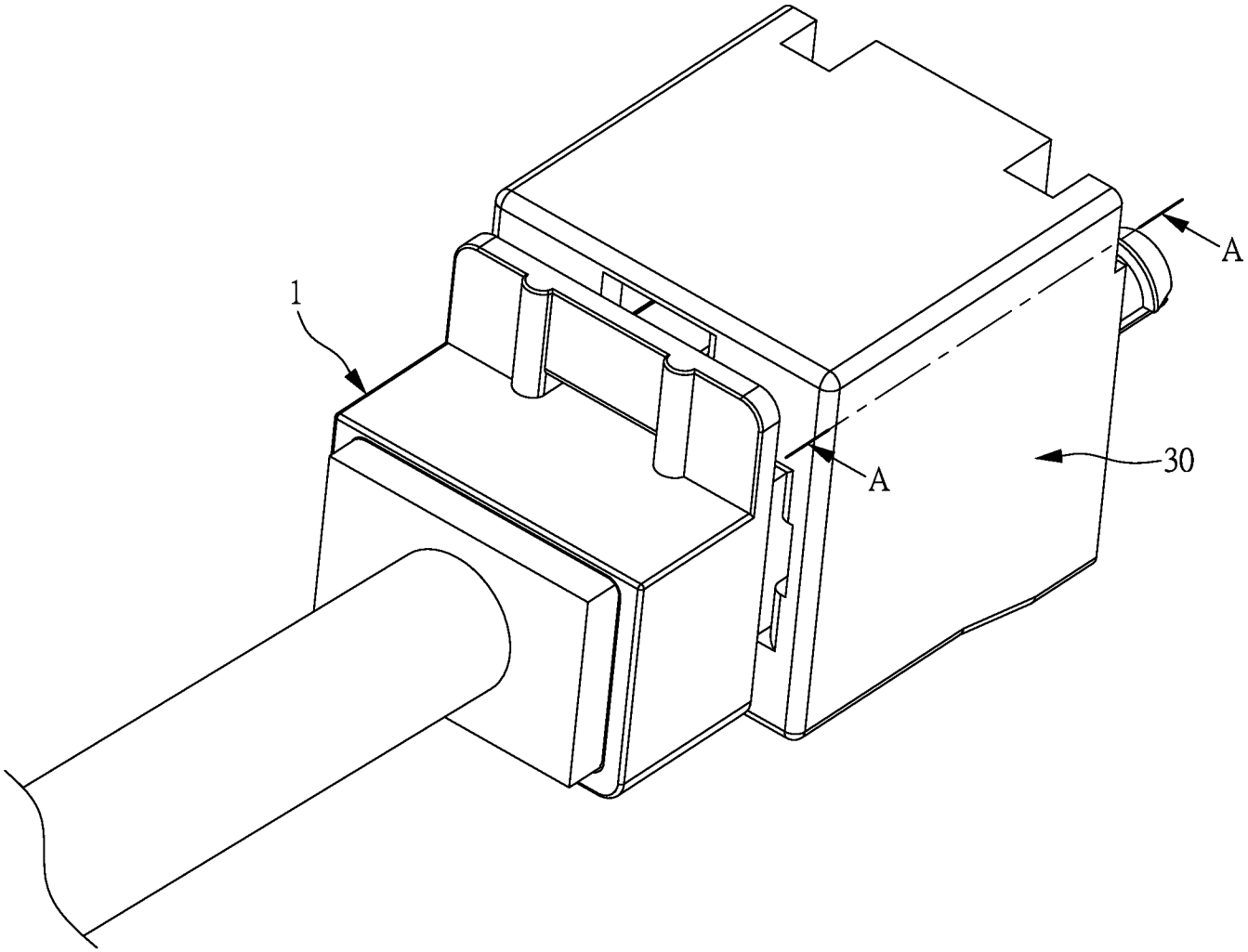
FIG. 2 is a perspective view illustrating a locking structure of a telecommunication connector according to the present invention, a corresponding connector body, and a socket in an inserted and coupled condition.
Figure 3:
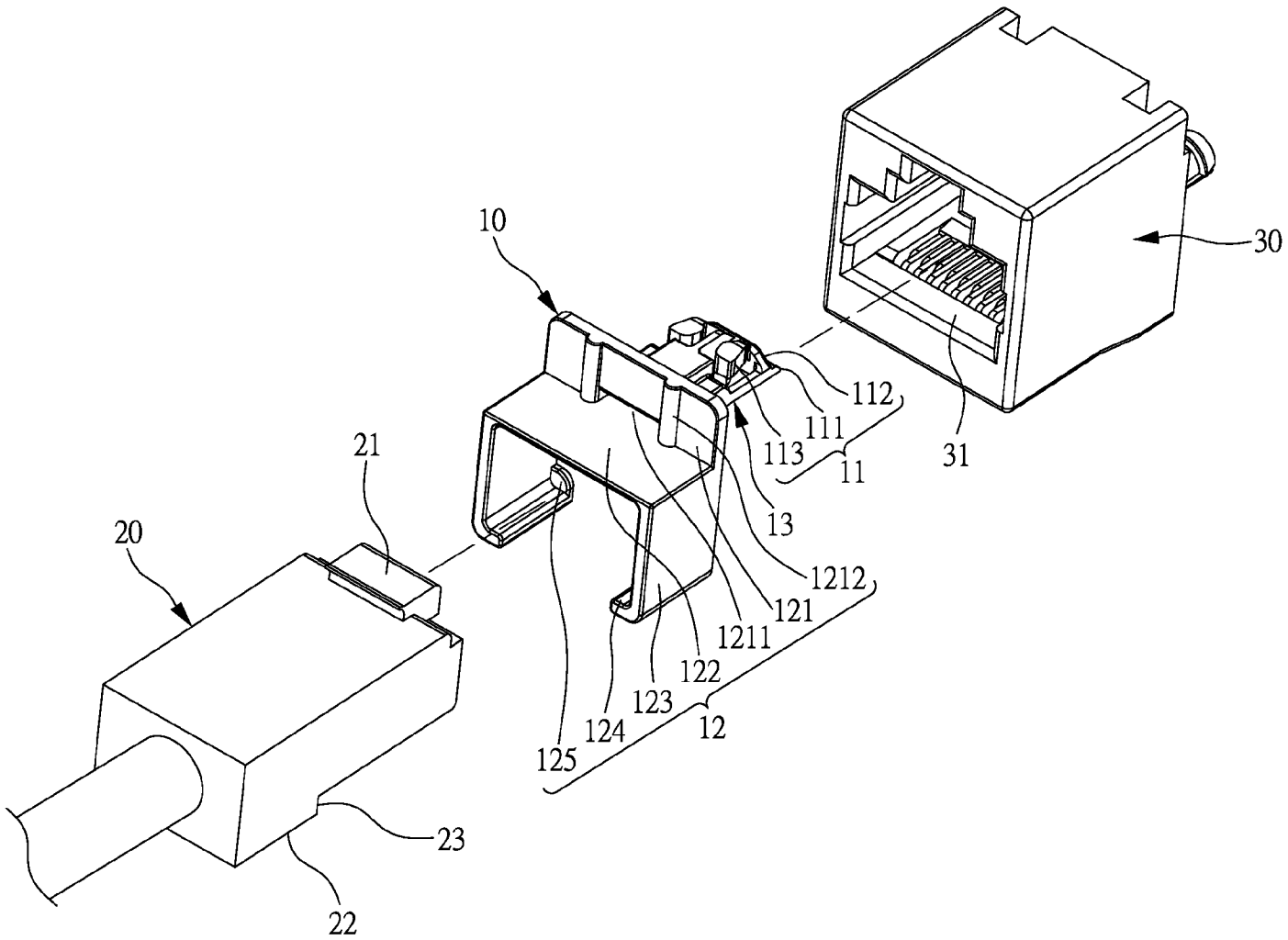
FIG. 3 is an exploded view illustrating a locking structure of a telecommunication connector and a corresponding connector body according to the present invention, and a socket.
Figure 4:
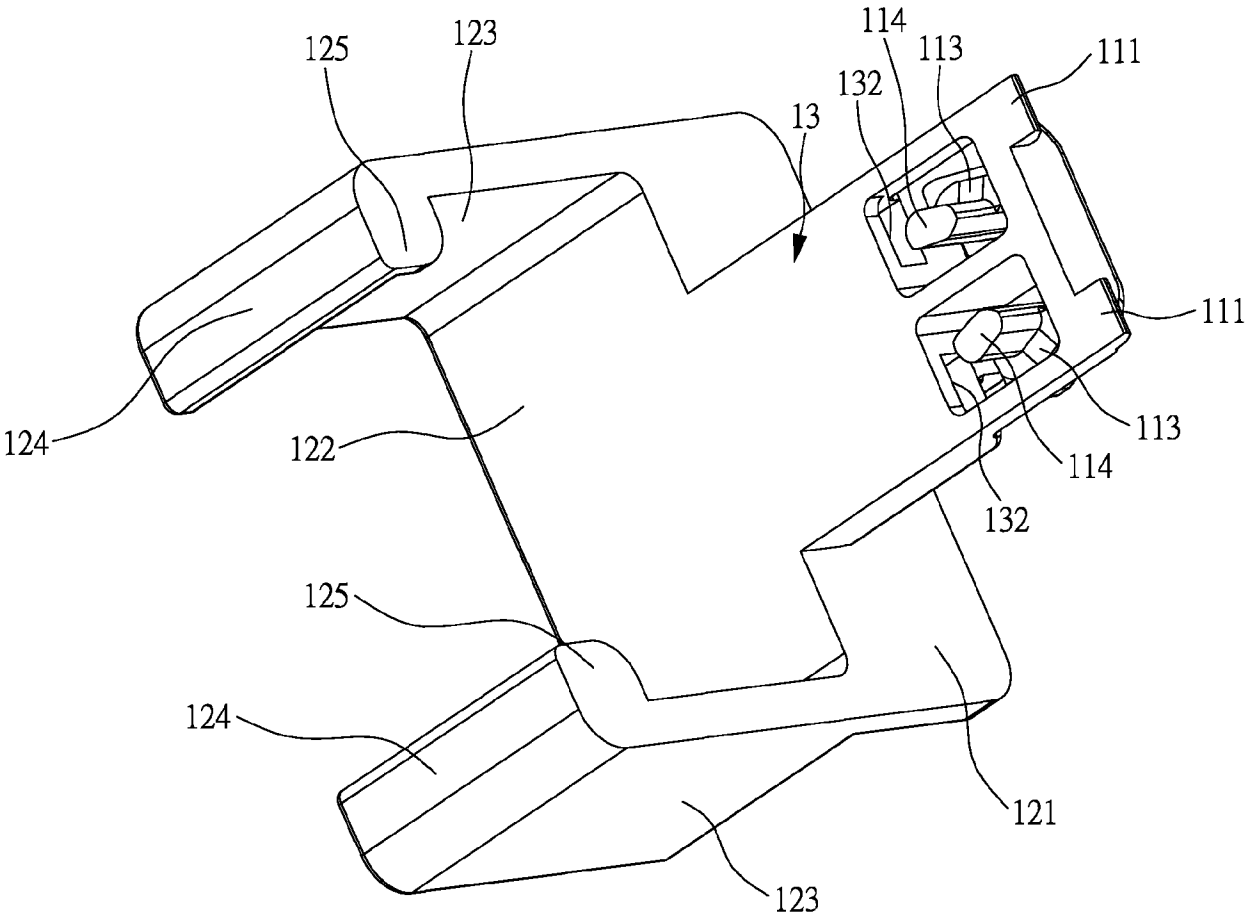
FIG. 4 is a perspective view illustrating a locking structure of a telecommunication connector according to the present invention.
Figure 5:
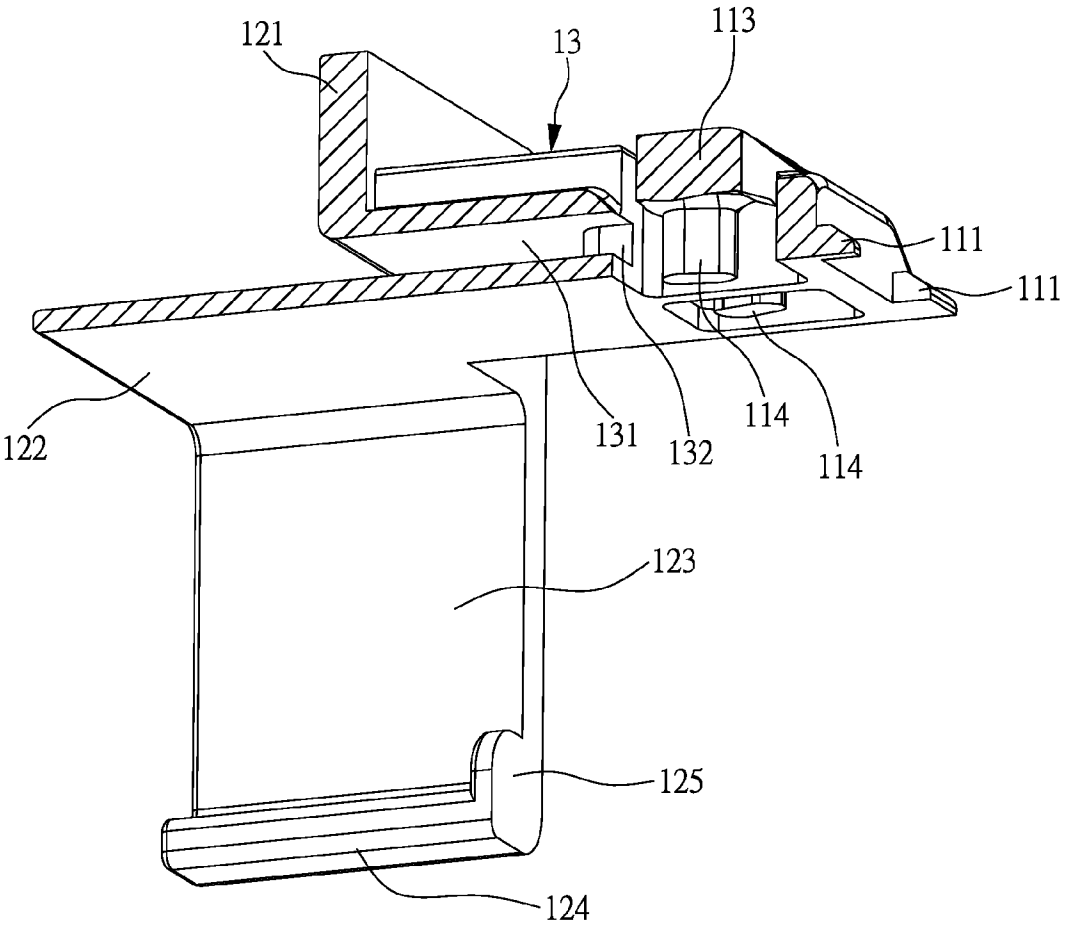
FIG. 5 is a cross-sectional view illustrating a locking structure of a telecommunication connector according to the present invention.

Referring collectively to FIGS. 1-5, the present invention provides a locking structure 10 for use with a telecommunication connector and comprising: a pull resistant section 11, which has a front end forming an engagement section 111 connected to a connection surface 112, wherein the connection surface 112 is connected to at least one spring arm 113 (multiple spring arms being illustrated in the drawings), and each of the spring arms 113 is provided with a projection 114 on an underside thereof; a locking section 12, which is a U-shaped configuration; and a connection section 13, which connects the pull resistant section 11 and the locking section 12 to each other and is formed with a cavity 131, wherein an end section of the cavity 131 is provided with an opening 132 corresponding to each of the spring arms 113 and the pull resistant section 11 is arranged to extend in a direction toward an insertion hole of a socket to be connected therewith, while the spring arms 113 of the pull resistant section 11 extend in a direction toward the locking section 12.

The locking section 12 comprises a vertical board 121, a horizontal board 122, two side boards 123, two barbs 124, and two stops 125. The vertical board 121 is mounted, in a perpendicular manner, on the horizontal board 122. The vertical board 121 is provided, in a bottom edge thereof, with a hole 1211, such that the hole 1211 corresponds to the cavity 131 of the connection section 13. The horizontal board 122 is arranged between the side boards 123 and connected to the side boards 123. The barbs 124 and the stops 125 are both mounted to lower ends of the side boards 123. Further, at least one reinforcement member 1212 is provided at connection between the vertical board 121 and the horizontal board 122 such that the reinforcement member 1212 reinforces the connection between the vertical board 121 and the horizontal board 122.

The connector body 20 is structured to wrap and thus house an end of a cable. The connector body 20 is provided, on a top of a front end thereof, with a protrusion 21, and the connector body 20 is provided, on a bottom of a rear end thereof, with barbs 22 and stops 23, so that when the locking structure 10 and the connector body 20 are combined, the barbs 124 and the stops 125 of the locking section 12 engage and couple with the barbs 22 and the stops 23 of the connector body 20 with the horizontal board 122 and the side boards 123 of the locking section 12 respectively covering a top and sides of the connector body 20 and the engagement section 111 on the front end of the pull resistant section 11 engaging the protrusion 21 of the connector body 20.

Figure 6:
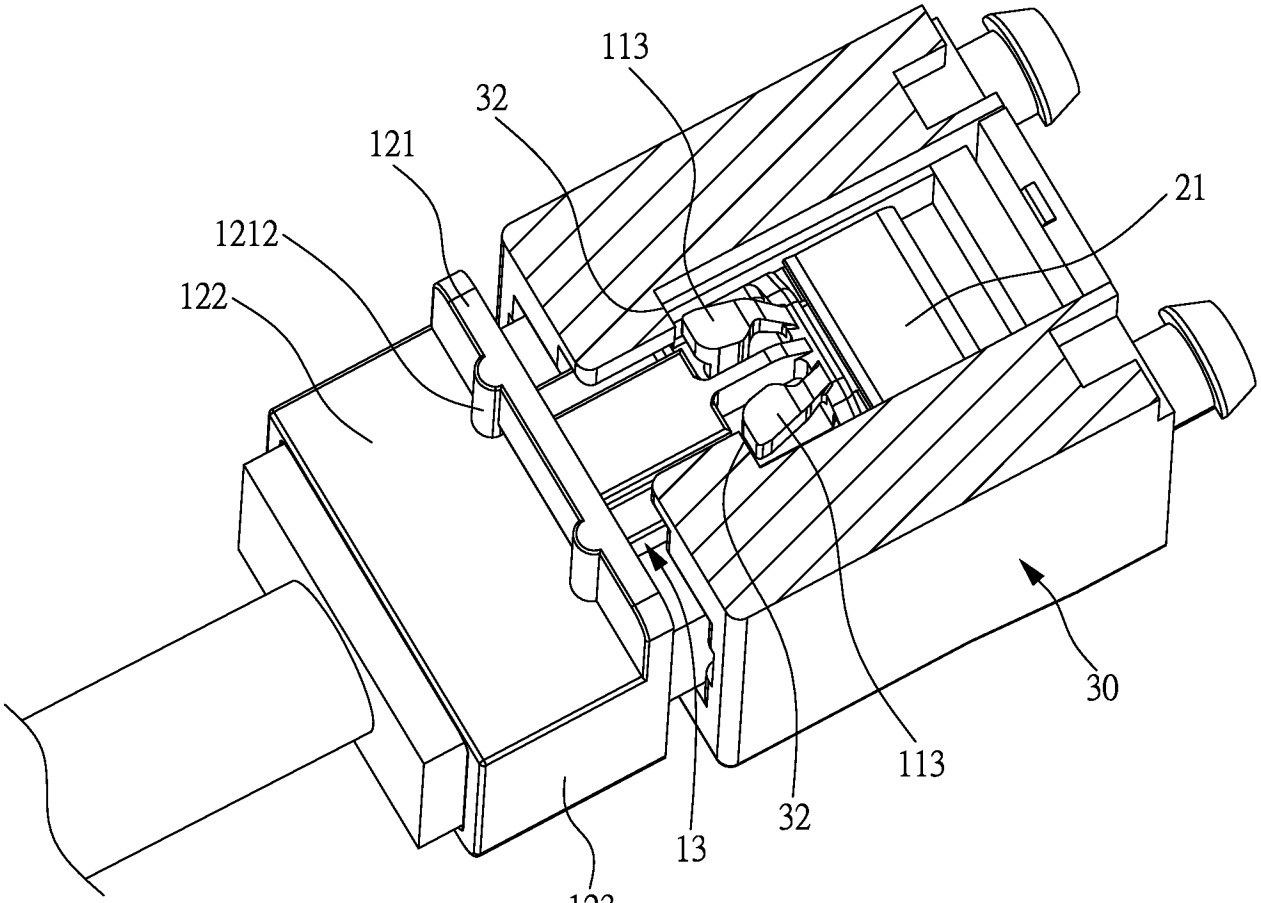
FIG. 6 is a cross-sectional view taken along line A-A of FIG. 2I

Referring also to FIG. 6, a cross-section is provided for depicting the locking structure of the telecommunication connector according to the present invention, together with the connector body, inserted or plugged into a socket. When the locking structure 10 and the connector body 20 are combined together to form a telecommunication connector 1 and are inserted into an insertion hole 31 of a socket 30, the pull resistant section 11 is received into and concealed in the insertion hole 31 of the socket 30 and the spring arms 113 are brought into engagement with a plurality of raised blocks 32 formed inside the socket 30 so that the telecommunication connector 1 is kept from being pulled out and removed from the socket 30.

Figure 7:
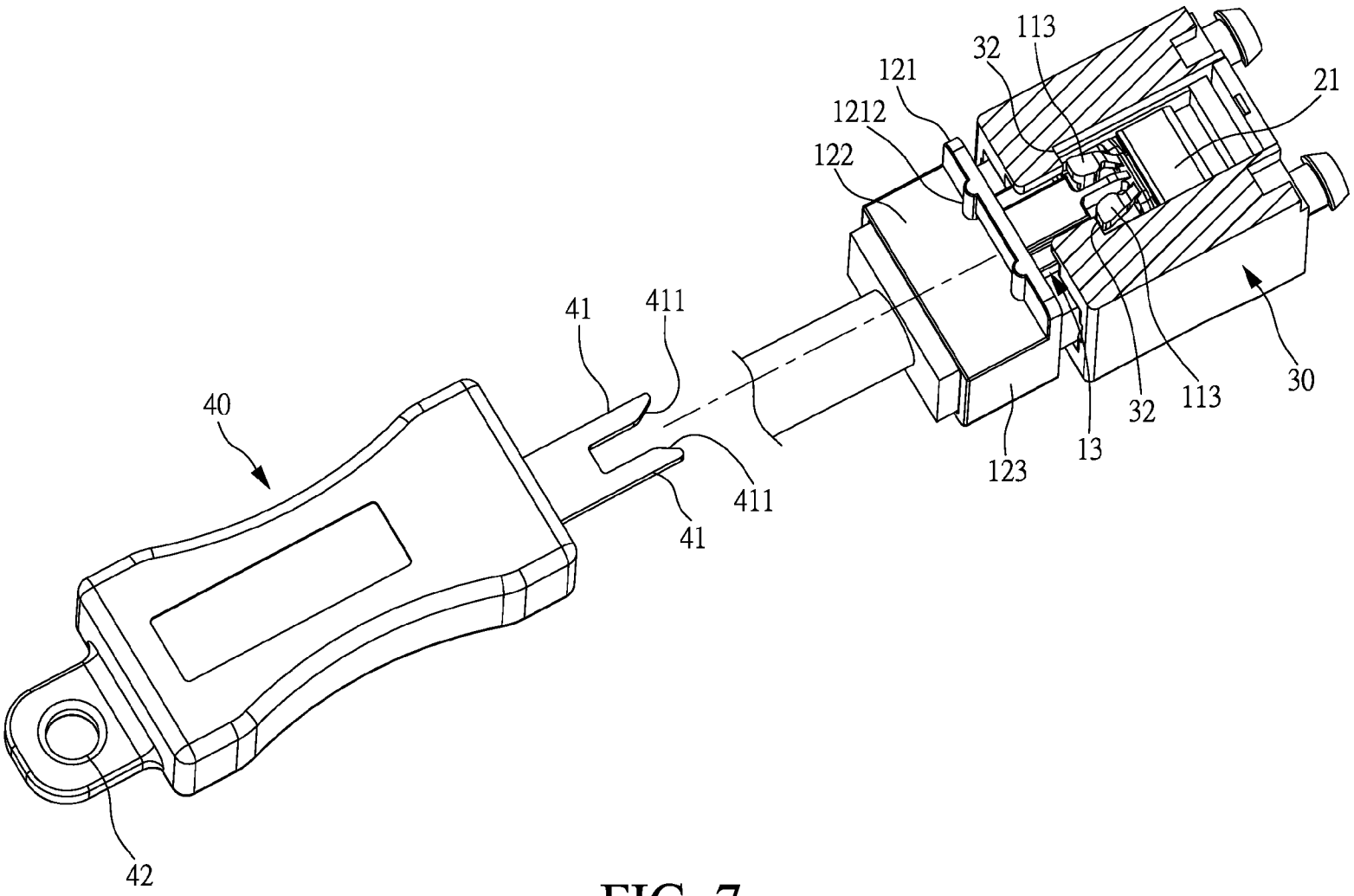
FIG. 7 is a perspective view illustrating unlocking of a locking structure of a telecommunication connector according to the present invention, together with a connector body, from a socket through application of an unlocker.
Figure 8:
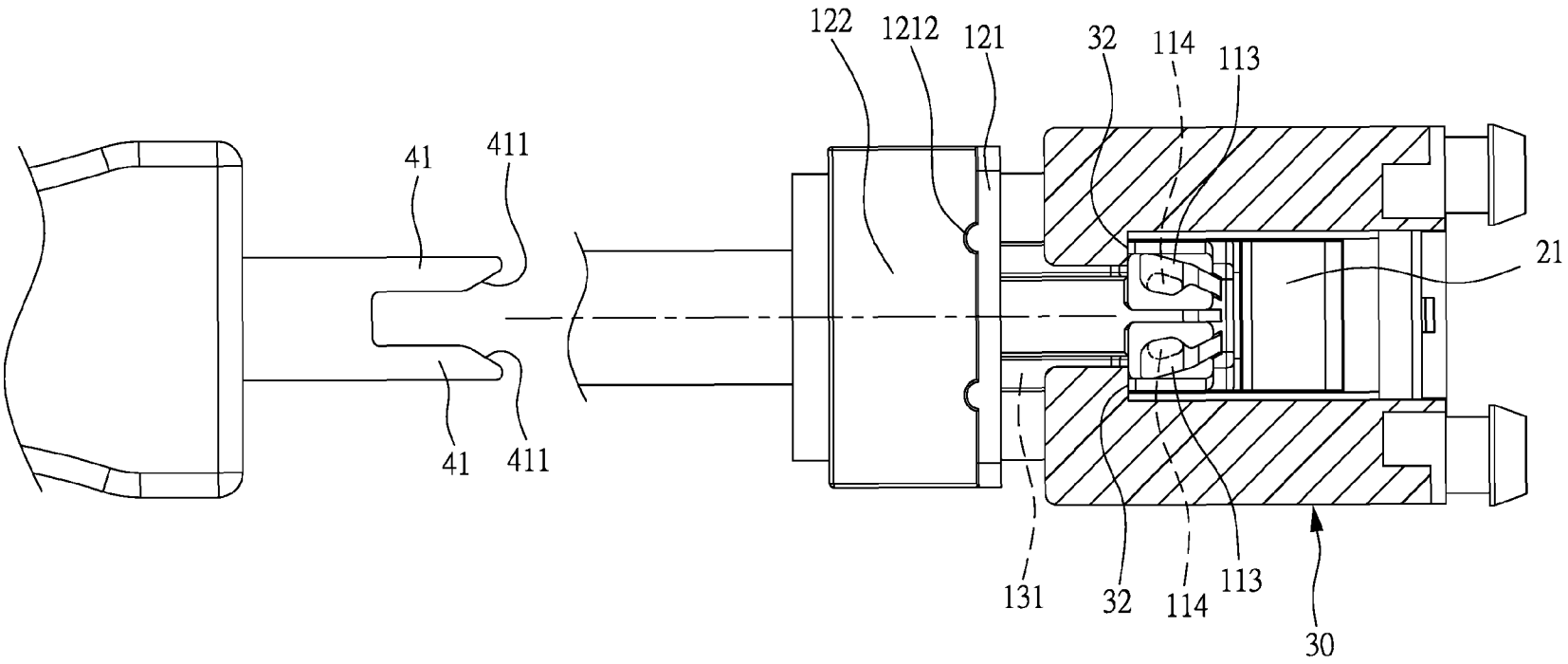
FIG. 8 is a top plan view illustrating a condition of FIG. 7 before the application of unlocker.
Figure 9:
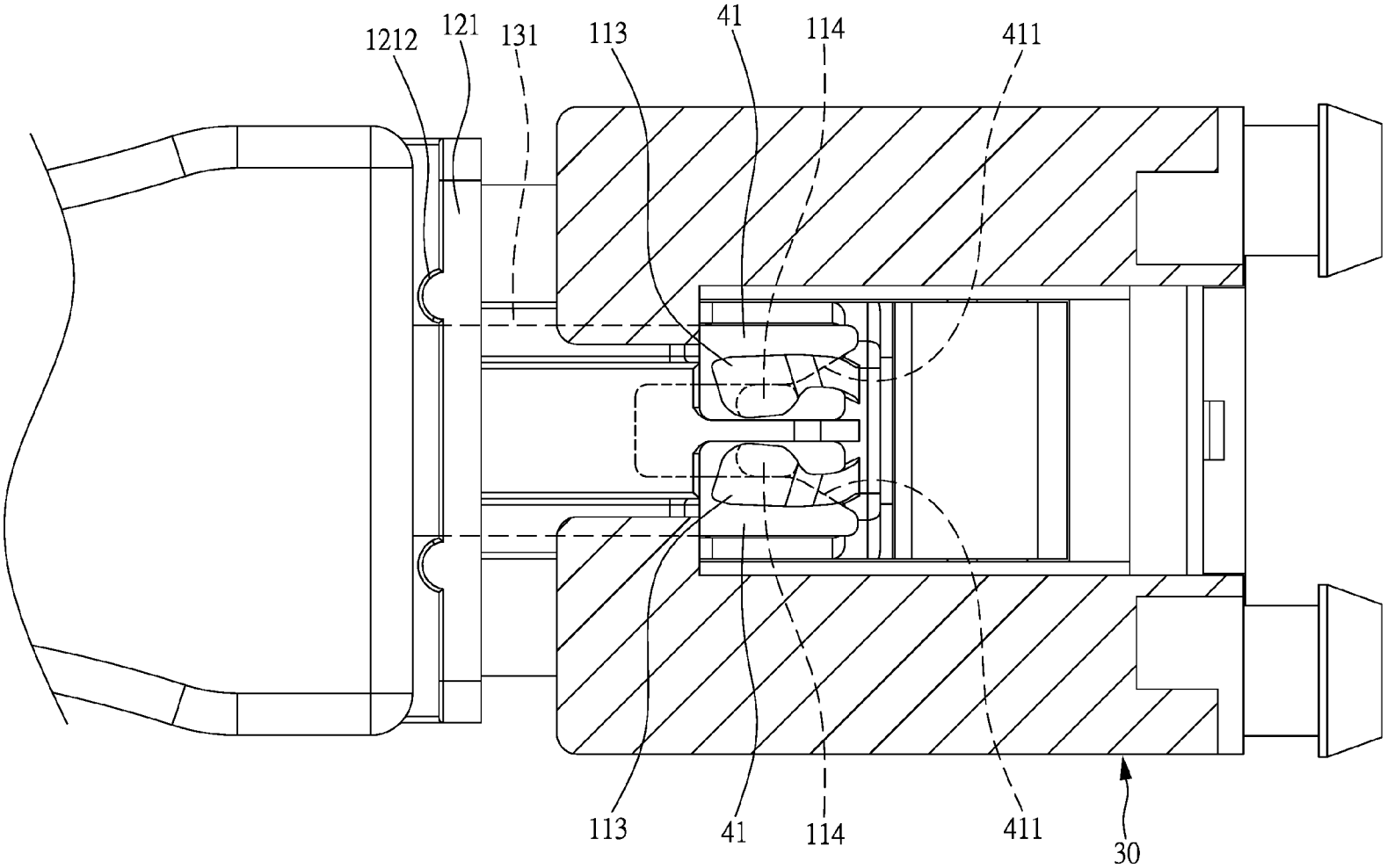
FIG. 9 is a top plan view illustrating a condition of FIG. 7 after the application of unlocker.

Referring to FIGS. 7-9, to pull and remove the telecommunication connector 1 from the insertion hole 31 of the socket 30, an unlocker 40 is first inserted into the locking structure 10 such that the unlocker 40 causes the projections 114 on the undersides of the spring arms 113 to deflect or move for converging toward each other so as to release the engagement between the spring arms 113 and the raised blocks 32 to thereby allow the telecommunication connector 1 to be pulled out and thus removed from the socket 30. The unlocker 40 has an end that comprises at least one extension arm 41, and the extension arm 41 has an end portion formed with an open hollow as an interior space defined by opposite side walls each having an inside forming a slope surface 411, so that when the extension arm 41 is inserted through the hole 1211 in the bottom of the vertical board 121 into the cavity 131 of the connection section and reaching out of the openings 132, the slope surfaces 411 of the extension arm 41 are brought into camming engagement with the projections 114 on the undersides of the spring arms 113 to compress the projections 114 inwards (as shown in FIG. 9), whereby the spring arms 113 are released from engagement with the raised blocks 32 and the telecommunication connector 1 is allowed to pull out of the socket 30.

Figure 10:
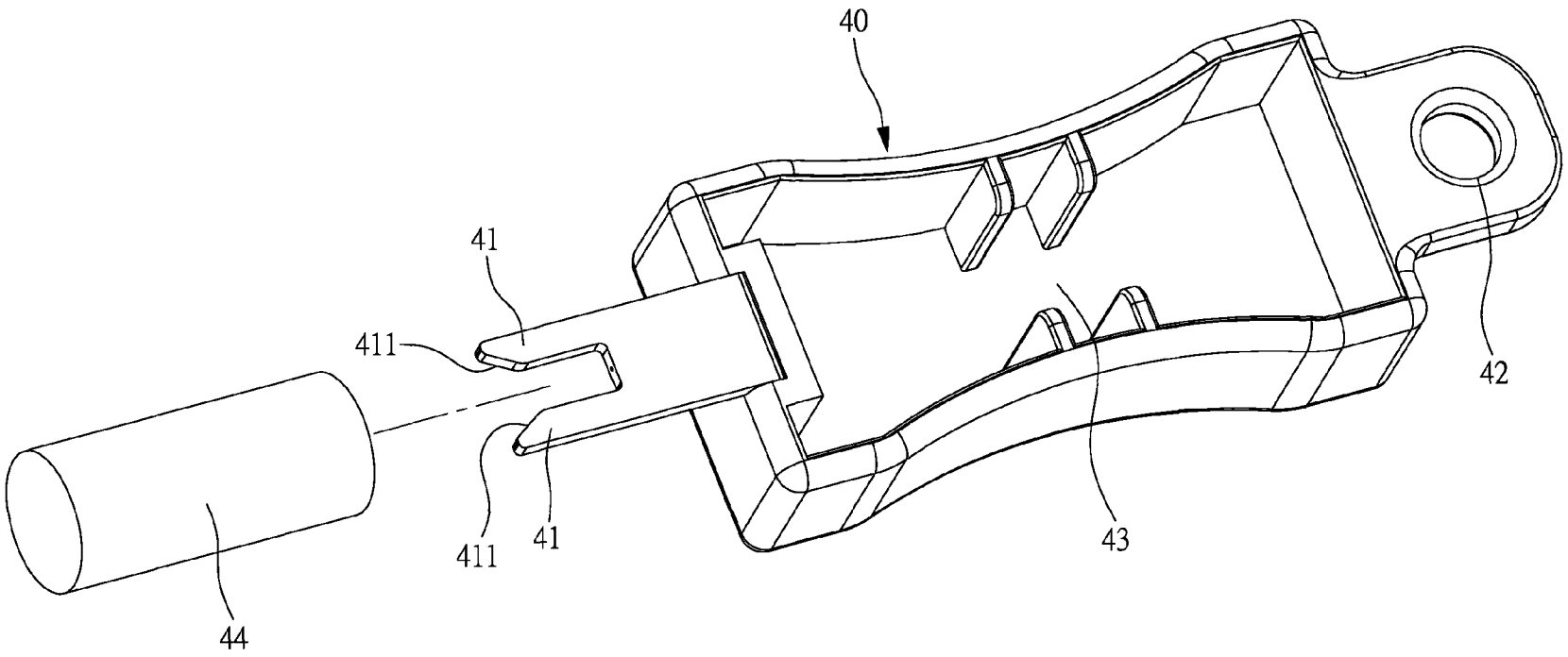
FIG. 10 is a perspective view, taken from a different angle, showing an unlocker for unlocking a locking structure of a telecommunication connector according to the present invention.

Further, referring also to FIG. 10, the unlocker 40 has another end that is opposite to the extension arm 41 and is formed with a hole 42, to allow a user to combine the unlocker 40 with an external article or object, such as a key ring, for preventing the unlocker 40 from getting lost. Finally, due to the extension arm 41 being slender and relatively acute, the extension arm 41 may receive a protection cover 44 fit thereto, and thus, in an attempt to conduct an unlocking operation with the unlocker 40, the protection cover 44 is first removed and positioned in an accommodation space 43 formed in the unlocker 40 to prevent the protection cover 44 from getting lost.

In the above embodiment, the locking structure 10 is described removably mounted on the connector body 20; however, in another embodiment, the locking structure 10 is integrated with the connector body 20 as a unitary structure.

Figure 11:
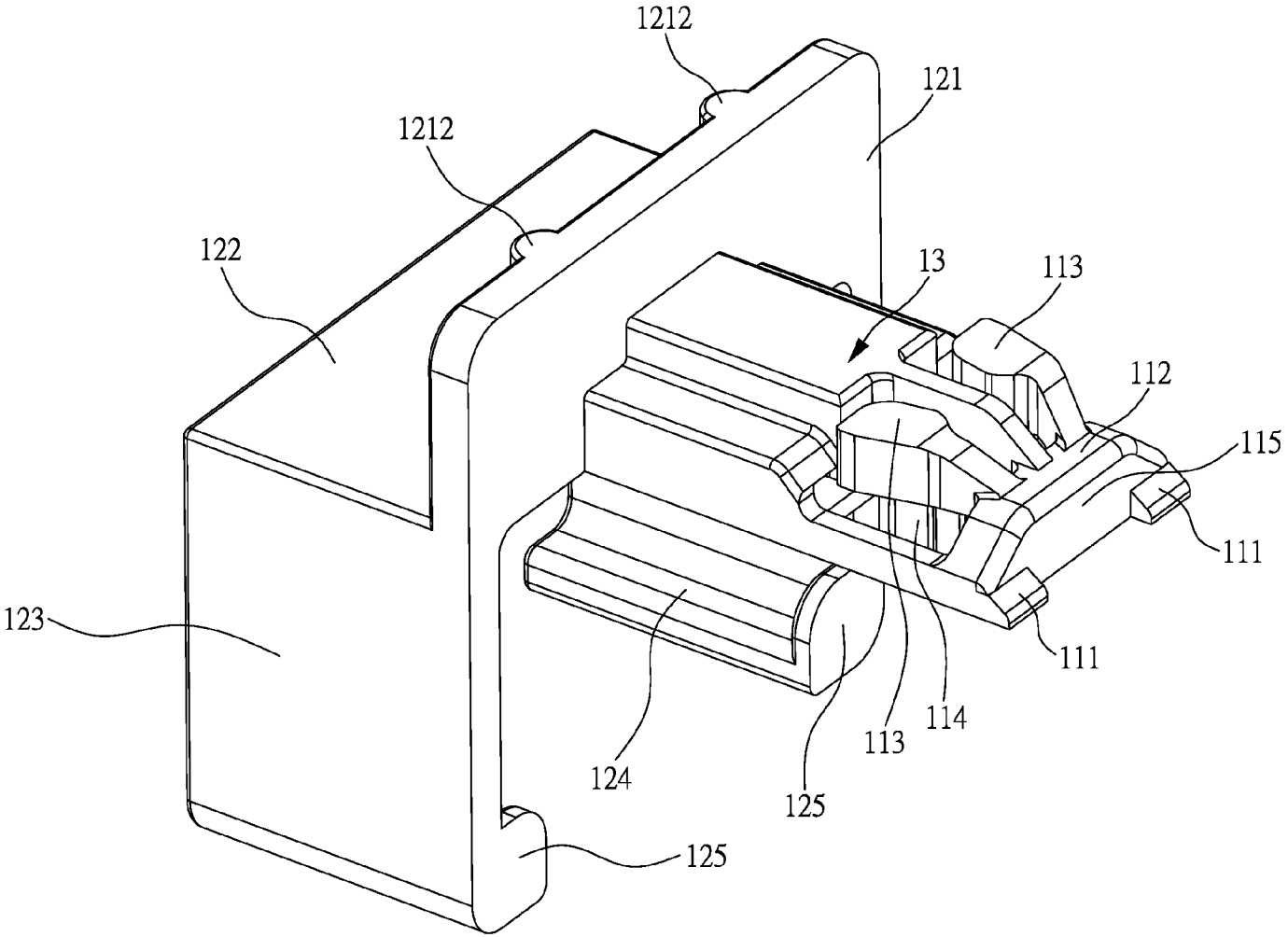
FIG. 11 is a perspective view illustrating a locking structure of a telecommunication connector according to another embodiment of the present invention.
Figure 12:
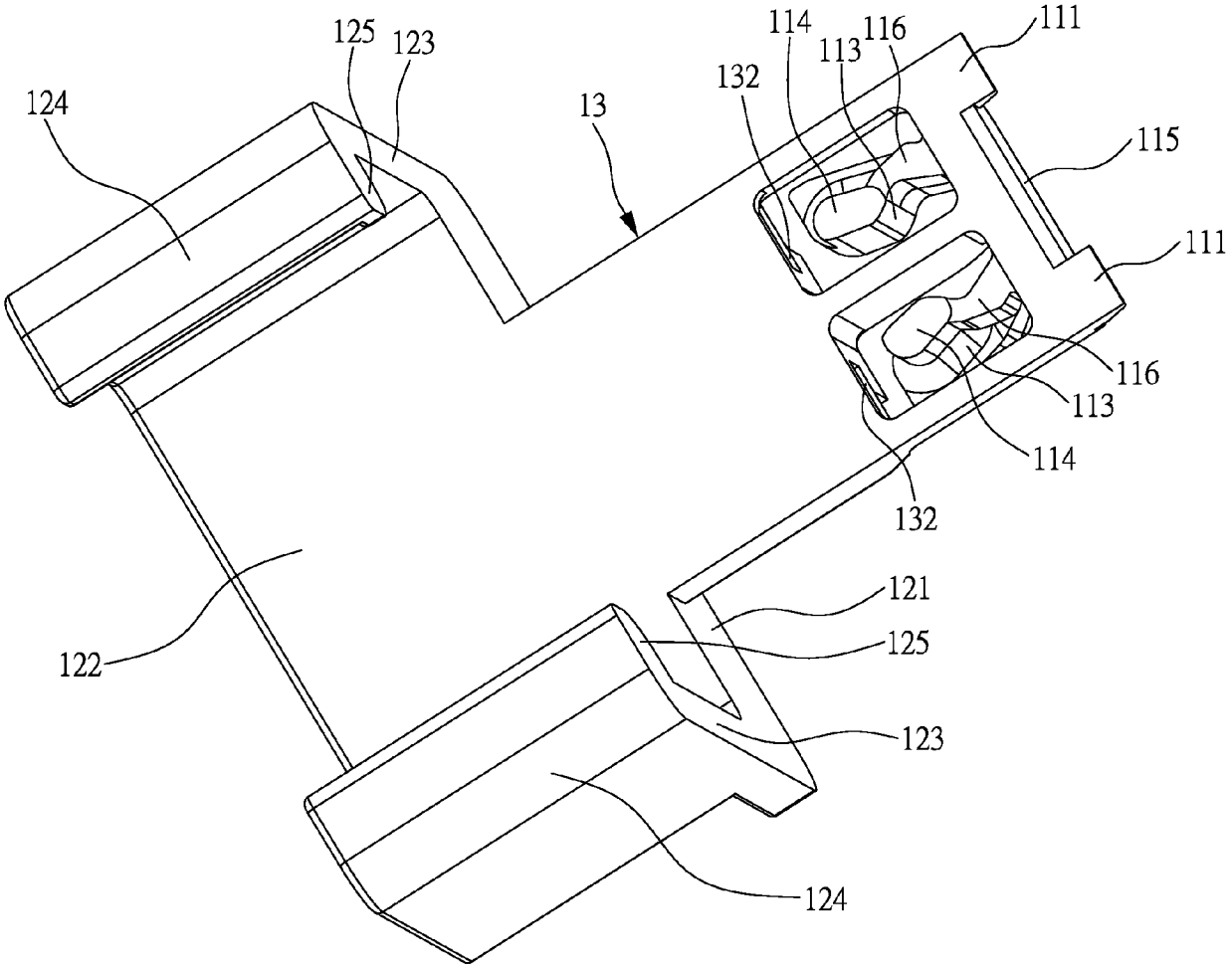
FIG. 12 is a perspective view, taken from a different angle, showing the locking structure of a telecommunication connector according to said another embodiment of the present invention.
Figure 13:
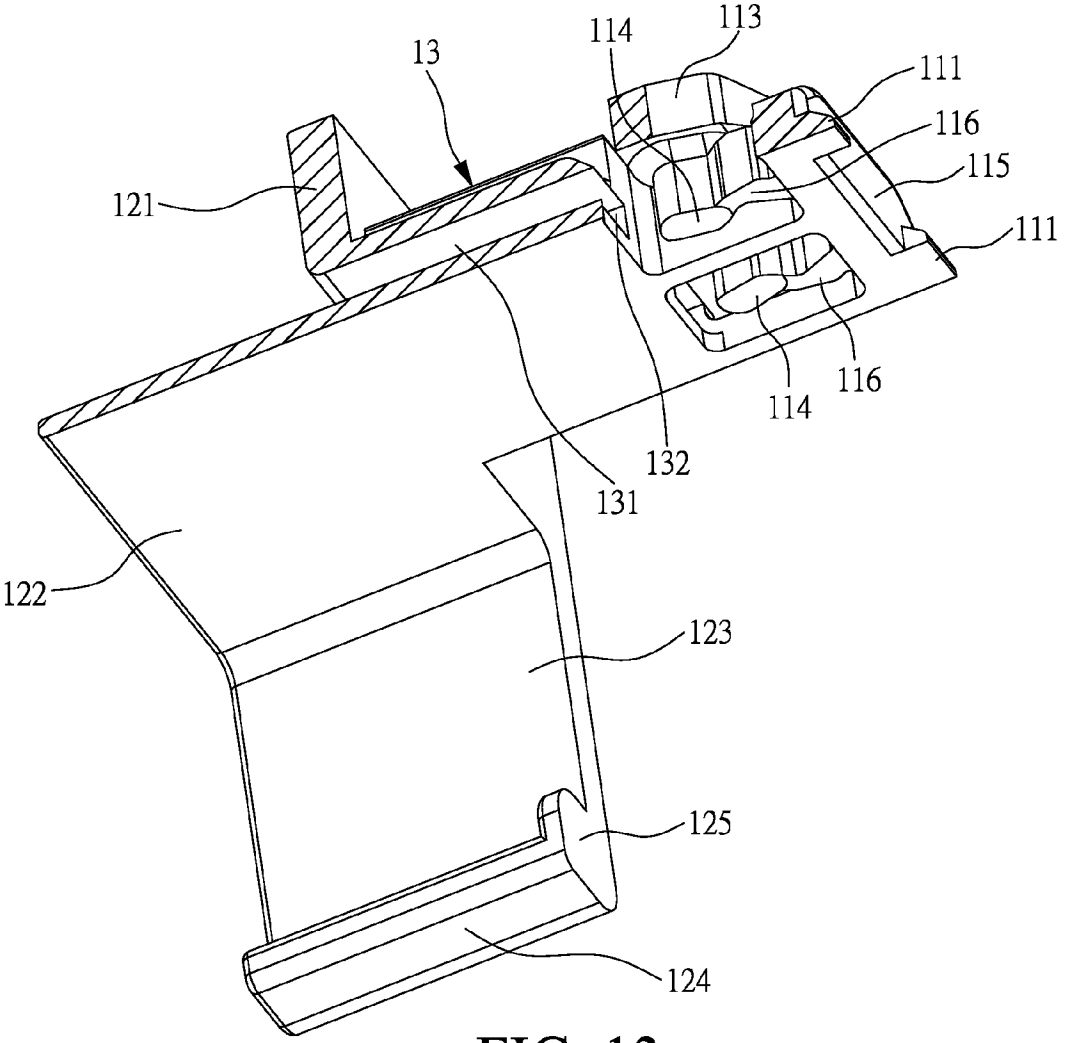
FIG. 13 is a cross-sectional view illustrating the locking structure of a telecommunication connector according to said another embodiment of the present invention.

Finally, referring to FIGS. 11-13, a locking structure is provided according to another embodiment of the present invention for use with a telecommunication connector, wherein a first reinforcement section 115 is provided between the engagement section 111 and the connection surface 112 and a second reinforcement section 116 is provided under each of the spring arms 113 and connected to the projection 114. The first reinforcement section 115 helps strengthen the base of the spring arm 113 and the second reinforcement sections 116 help prevent the spring arms 113 from warping upwards due to the insertion of the extension arm 41 of the unlocker 40.

The present invention provides a locking structure of a telecommunication connector, which comprises a pull resistant section and a locking section connected together by a connection section and the locking structure is connected through the locking section to a connector body to form a telecommunication connector that is insertable or pluggable into a socket, wherein the pull resistant section of the locking structure is received and concealed in an insertion hole of the socket and spring arms of the pull resistant section are brought into engagement with a plurality of raised blocks formed inside the socket, such that an unlocker of a specific design must be used by inserting into the locking structure to release the engagement between the locking structure and the socket. As such, unauthorized or unexpected removal of the telecommunication connector is prevented and security and protection of data can be enhanced against being stolen by others. The present invention can be used, in a condition that a conventional spring arm of a telecommunication connector is broken or undergoes elastic fatigue, to replace the conventional spring arm through combination with the conventional telecommunication connector, or may alternatively, be integrally formed with a connector body to form a telecommunication connector, both being helpful in preventing the telecommunication connector from being removed or pulled out of a socket unexpectedly.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A locking structure for use with a telecommunication connector, the locking structure comprising:

a pull resistant section, which has a front end forming an engagement section connected to a connection surface, the connection surface being connected to at least one spring arm, the spring arm being provided with a projection on an underside thereof;

a locking section, which is a U-shaped configuration; and a connection section, which connects the pull resistant section and the locking section, the connection section being formed with a cavity, the cavity having an end section in which an opening is formed to correspond to the spring arm;

wherein the locking structure is combinable with a connector body to form the telecommunication connector, which is pluggable into a socket such that the pull resistant section is received into and concealed in an insertion hole of the socket and the spring arm is in engagement with a plurality of raised blocks formed inside the socket to prevent the telecommunication connector from being removed out of the socket;

wherein the locking section comprises a vertical board, a horizontal board, two side boards, two barbs, and two stops, the vertical board being mounted on the horizontal board to be perpendicular thereto, the vertical board comprising a hole in a bottom edge thereof such that the hole corresponds to the cavity of the connection section, the horizontal board being arranged between the side boards and connected to the side boards, the barbs and the stops being mounted to lower ends of the side boards.

2. The locking structure as claimed in claim 1, wherein the engagement section and the connection surface comprise a first reinforcement section formed therebetween and the spring arm comprises a second reinforcement section formed on the underside thereof and connected to the projection.

3. The locking structure as claimed in claim 1, wherein the pull resistant section extends in a direction toward the insertion hole and the spring arm of the pull resistant section extends in a direction toward the locking section.

4. The locking structure as claimed in claim 1, wherein at least one reinforcement member is provided at connection between the vertical board and the horizontal board.

5. The locking structure as claimed in claim 1, wherein the connector body wraps and houses an end of a cable and the connector body comprises a protrusion formed at a top of a front end thereof, the connector body comprising barbs and stops formed at a bottom of a rear end thereof such that the combination of the locking structure and the connector body brings the barbs and the stops of the locking section into retaining engagement with the barbs and the stops of the connector body and the horizontal board and the side boards of the locking section respectively cover a top and sides of the connector body, the engagement section of the front end of the pull resistant section being brought into engagement with the protrusion.

6. The locking structure as claimed in claim 1, wherein the locking structure and the connector body are integrally formed together as a unitary structure.

7. A locking structure for use with a telecommunication connector, the locking structure comprising:

a pull resistant section, which has a front end forming an engagement section connected to a connection surface, the connection surface being connected to at least one spring arm, the spring arm being provided with a projection on an underside thereof;

a locking section, which is a U-shaped configuration;

a connection section, which connects the pull resistant section and the locking section, the connection section being formed with a cavity, the cavity having an end section in which an opening is formed to correspond to the spring arm; and a removing tool;

wherein the locking structure is combinable with a connector body to form the telecommunication connector, which is pluggable into a socket such that the pull resistant section is received into and concealed in an insertion hole of the socket and the spring arm is in engagement with a plurality of raised blocks formed inside the socket to prevent the telecommunication connector from being removed out of the socket;

wherein the removing tool is operable to move the projection on the underside of the spring arm in order to release the engagement between the spring arm and the raised blocks and allow the telecommunication connector to be removed out of the socket;

wherein the removing tool has an end that comprises at least one extension arm, and the extension arm has an end portion having an interior space having an inside surface forming a slope surface, such that the slope surface of the extension arm, when brought into camming engagement with the projection on the underside of the spring arm, causes the spring arm to break the engagement thereof with the raised blocks so as to allow the telecommunication connector to be removed out of the socket.

8. The locking structure as claimed in claim 7, wherein the removing tool comprises a hole formed therein.

9. The locking structure as claimed in claim 7, wherein the removing tool comprises an accommodation space formed therein.

* * * * *